US009205893B2

(12) United States Patent
Posner

(10) Patent No.: US 9,205,893 B2
(45) Date of Patent: Dec. 8, 2015

(54) MOORING WHIP VERTICAL MOUNTING SWIVEL SUPPORT BASE

(71) Applicant: Samuel Posner, North Miami Beach, FL (US)

(72) Inventor: Samuel Posner, North Miami Beach, FL (US)

( * ) Notice: Subject to any disclaimer, the term of this patent is extended or adjusted under 35 U.S.C. 154(b) by 37 days.

(21) Appl. No.: 13/728,166

(22) Filed: Dec. 27, 2012

(65) Prior Publication Data

US 2014/0182503 A1 Jul. 3, 2014

(51) Int. Cl.
*B63B 21/00* (2006.01)

(52) U.S. Cl.
CPC ..... *B63B 21/00* (2013.01); *B63B 2021/001* (2013.01)

(58) Field of Classification Search
CPC ..... B63B 21/00; B63B 2021/001; E02B 3/24
USPC ..... 114/230.11, 230.1; 248/514, 207, 248/227.3, 513, 536
See application file for complete search history.

(56) References Cited

U.S. PATENT DOCUMENTS

| | | | | | |
|---|---|---|---|---|---|
| 3,941,340 | A * | 3/1976 | Rankins | 248/514 |
| 4,040,377 | A * | 8/1977 | Olsen | 114/230.11 |
| D306,396 | S * | 3/1990 | Brushaber | D8/355 |
| 5,588,630 | A * | 12/1996 | Chen-Chao | 248/514 |
| 6,484,987 | B2 * | 11/2002 | Weaver | 248/278.1 |
| 6,578,509 | B1 * | 6/2003 | Brushaber | 114/230.11 |

* cited by examiner

*Primary Examiner* — Anthony Wiest

(57) ABSTRACT

An improved mooring whip support base mounted vertically to a dock piling one embodiment having the means to rotate a housing supporting an inserted flexible mooring whip pole and means to lock said rotated mooring whip pole in a vertical position clearing the mooring whip pole from interfering with a vessel when leaving or returning from a dock when released the said rotating housing and mooring whip pole is manually lowered down to a determined desired degree positioning the flexible mooring whip pole a line or rope attached to the mooring whip base through a pulley at the end of the mooring whip pole and attached to the boat cleat keeping a boat from contacting a dock and possible damage.

1 Claim, 6 Drawing Sheets note: cleat 10 not shown note: cleat 10 not shown

MOORING WHIP VERTICAL MOUNTING SWIVEL SUPPORT BASE

Reference Cited:
Olsen U.S. Pat. No. 4,040,377 . . . August 1977
Brushaber U.S. No. D306396 . . . March 1987

BACKGROUND

1. Field of Invention

This invention relates to a mooring whip maintaining boats at a safe distance from a dock so as to prevent damage to said boat from colliding with the dock due to common occurrences such as tidal changes, wakes from passing boats or wind by means of fixed position bases mounted to a dock attached to said base are flexible poles extending out beyond the boat which is positioned parallel to the dock. These said bases are positioned one for the bow and one for the stern. Attached to these said poles are lines or ropes one end attached to the boat cleats then through a pulley fixed to the end of each pole then fixed to the mooring whip base. The spring action of the flexible poles keeps the boat pulled away from the dock.

2. Prior Art

It has been common to provide mooring whip bases that are of a variety of fixed horizontal deck mounted bases which are in most cases fastened to a wooden planked dock. Dock planks are generally not designed to support such loads with particularly small bases as shown in the prior art. Proper installation is also extremely difficult since access under a dock to install additional mounting equipment such as backing plates washers and nuts is not easily accessible. Also no other prior art has effectively addressed the problem of mooring whips protruding out over the boat interfering with parts of the boat such as structures deck equipment rigging lines permanent fishing equipment and other obstructions making it difficult if not impossible to leave and return to the dock without coming in contact with mooring whip poles and the boat since these mooring whips are generally in a fixed position. Olsen U.S. Pat. No. 4,040,377 attempts to satisfy the interference of the whip poles with the moored boat by suggesting the use of a small compressed rubber insert claiming this insert has the resilient ability to force the return to a vertical position a solid fiberglass pole with extreme cantilever loads in the range of fourteen feet in length this also puts extreme loads on the three bolt arrangement on Olsen's support base. In reality this small insert is effective for only a short period of time due to weather exposure and material memory it eventually completely fails to function as proposed. Brushaber U.S. Pat. No. D306396 is adjustable to be vertically positioned but only with the use of tools, this is not a practical feature when leaving or arriving at a dock it is also not designed to be mounted on the side of a piling only the face which protrudes out towards the boat presenting an obstacle which may cause extreme damage.

SUMMARY

In accordance with one embodiment is a mooring whip system vertically mounted securely to a dock piling by means of a support base when in a normal operating position down or angled keeps a boat a safe distance from a dock avoiding damage. The preferred embodiment also has a housing support for the pole or whip which has the means to swivel or rotate from the normal operating position to a vertical position providing boat clearance of the pole or whip when departing or returning to a dock.

DRAWINGS

A better understanding of the invention and its various features and advantages will be had by referring to the following detailed description taken in conjunction with the accompanying drawings in which.

DRAWINGS REFERENCE NUMBERS

Figure 1:
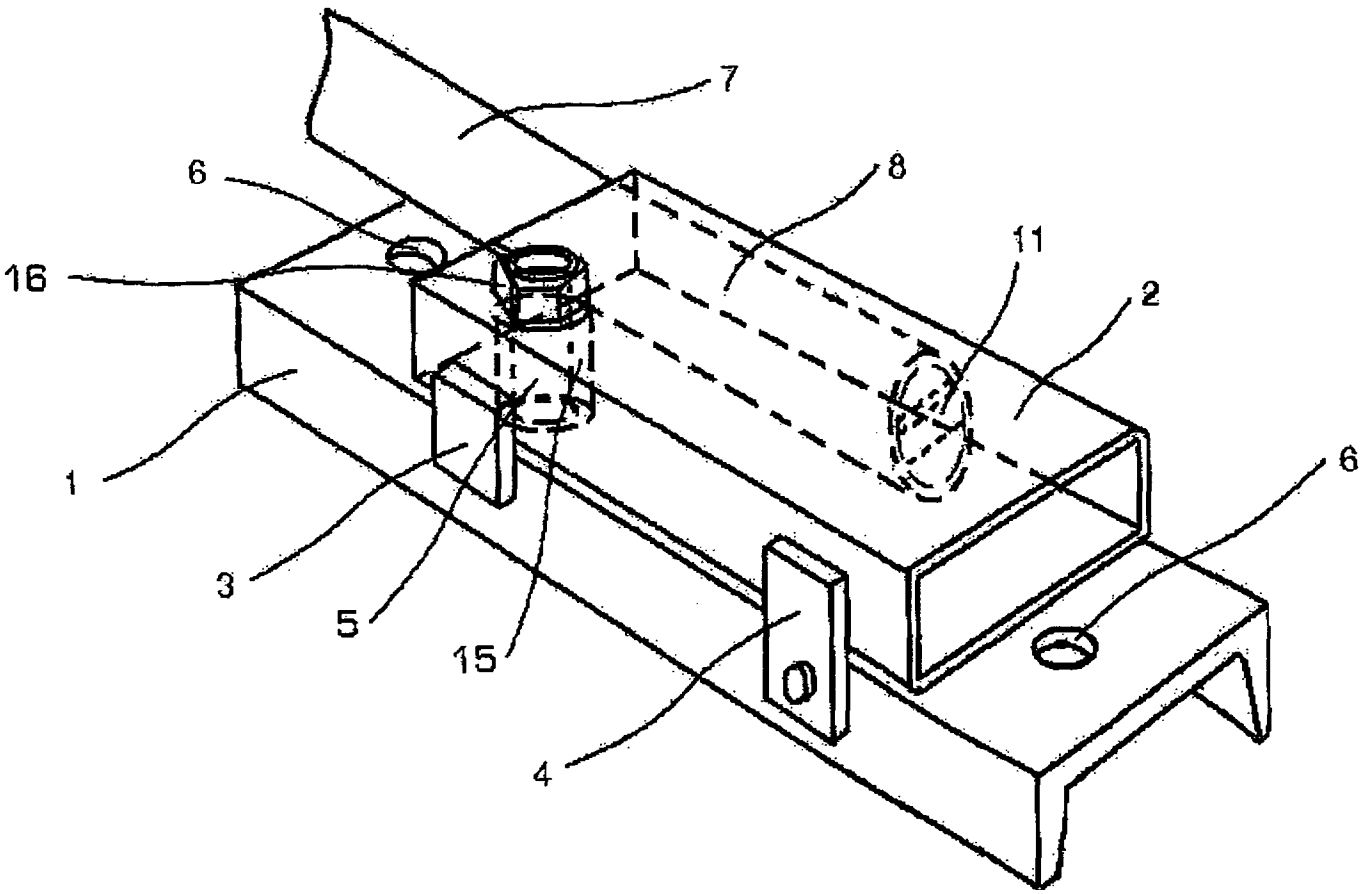
FIG. 1 shows an isometric perspective view of a preferred embodiment of the assembled mooring whip base in the vertical position.

1 Mounting Support
2 Rotatable whip pole housing support
3 Resting and limit stop
4 Vertical Position Lock
5 Mounting support shaft bolt
6 Mounting Support Mounting Hole
7 Whip Pole
8 Whip Pole Tube Support
9 Piling
10 Base Cleat
11 Whip pole stop
12 Pulley
13 Whip Line
14 Boat cleat
15 Shaft Bearing
16 Mounting support shaft retaining nut
17 Boat dock
18 Bolt Shaft for Vertical Position Lock

A BRIEF DESCRIPTION OF THE INVENTION

FIGS. 1 Through 5

Preferred Embodiment

Figure 2:
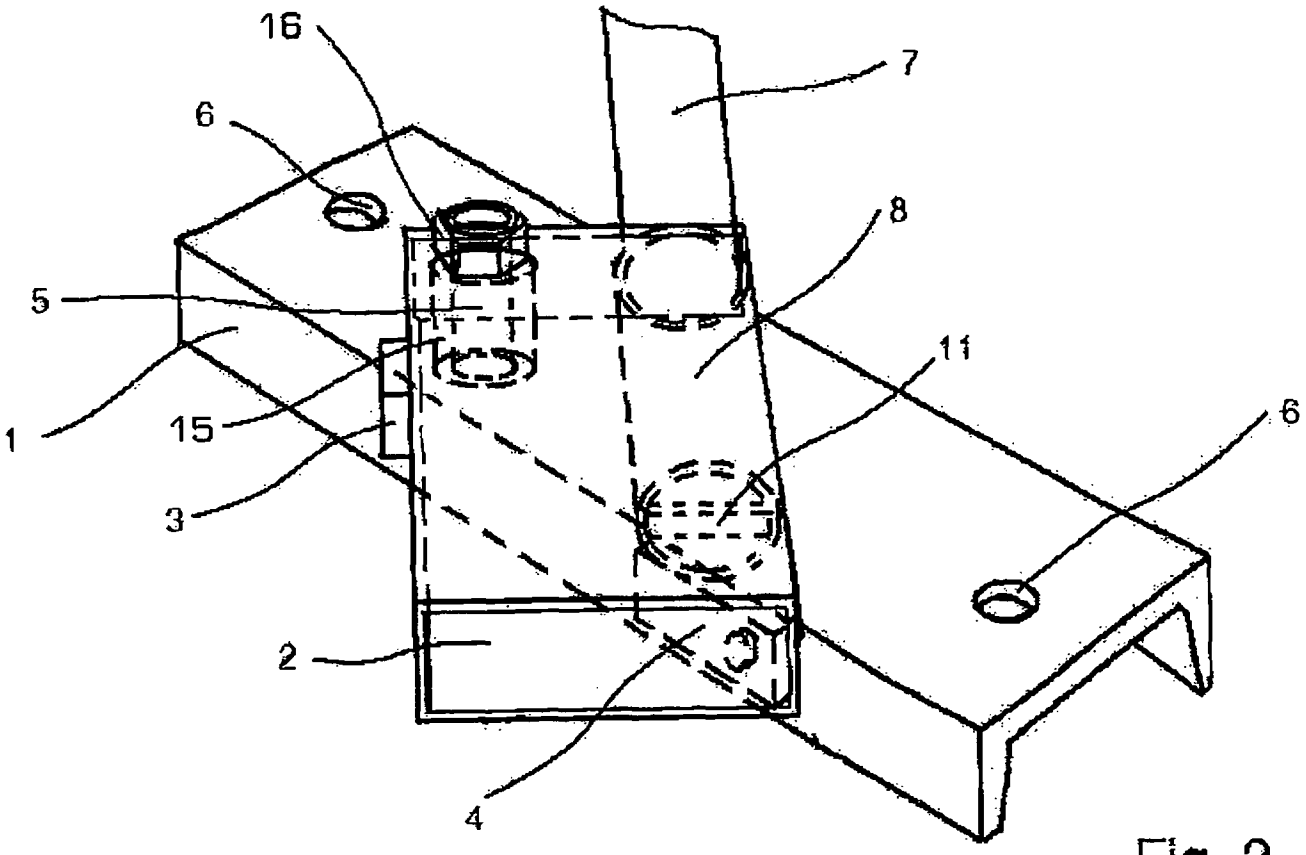
FIG. 2 shows an isometric perspective view of a preferred embodiment of the assembled mooring whip base in the angled position.
Figure 3:
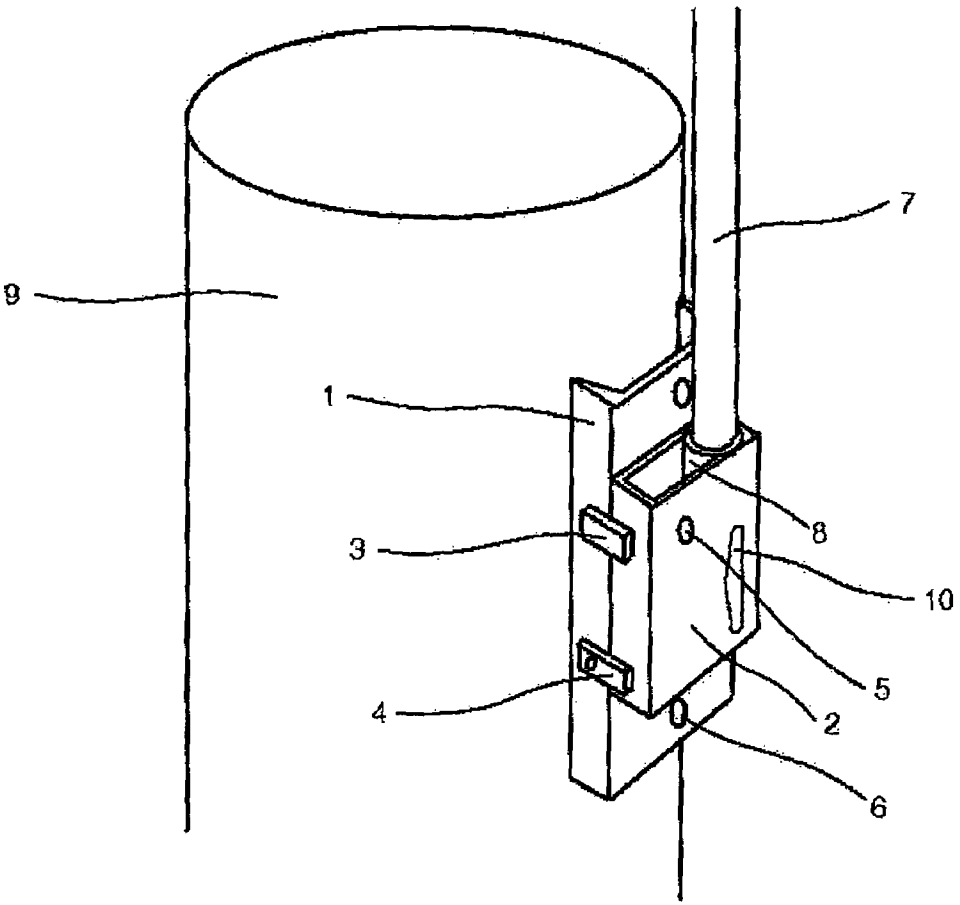
FIG. 3 shows an isometric perspective view of a preferred embodiment of the assembled mooring whip base in the vertical position mounted on a dock piling.
Figure 4:
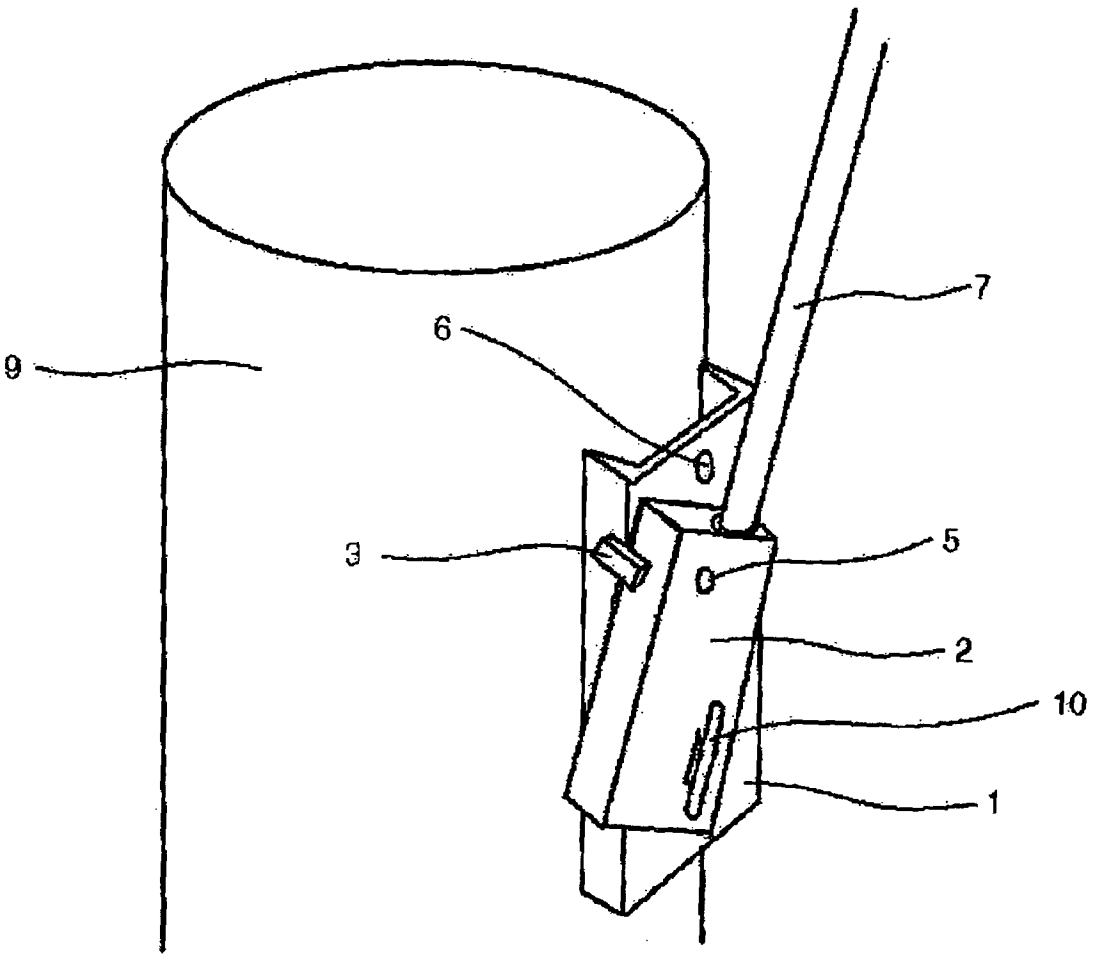
FIG. 4 shows an isometric perspective view of a preferred embodiment of the assembled mooring whip base in the angled position mounted on a dock piling.
Figure 5:
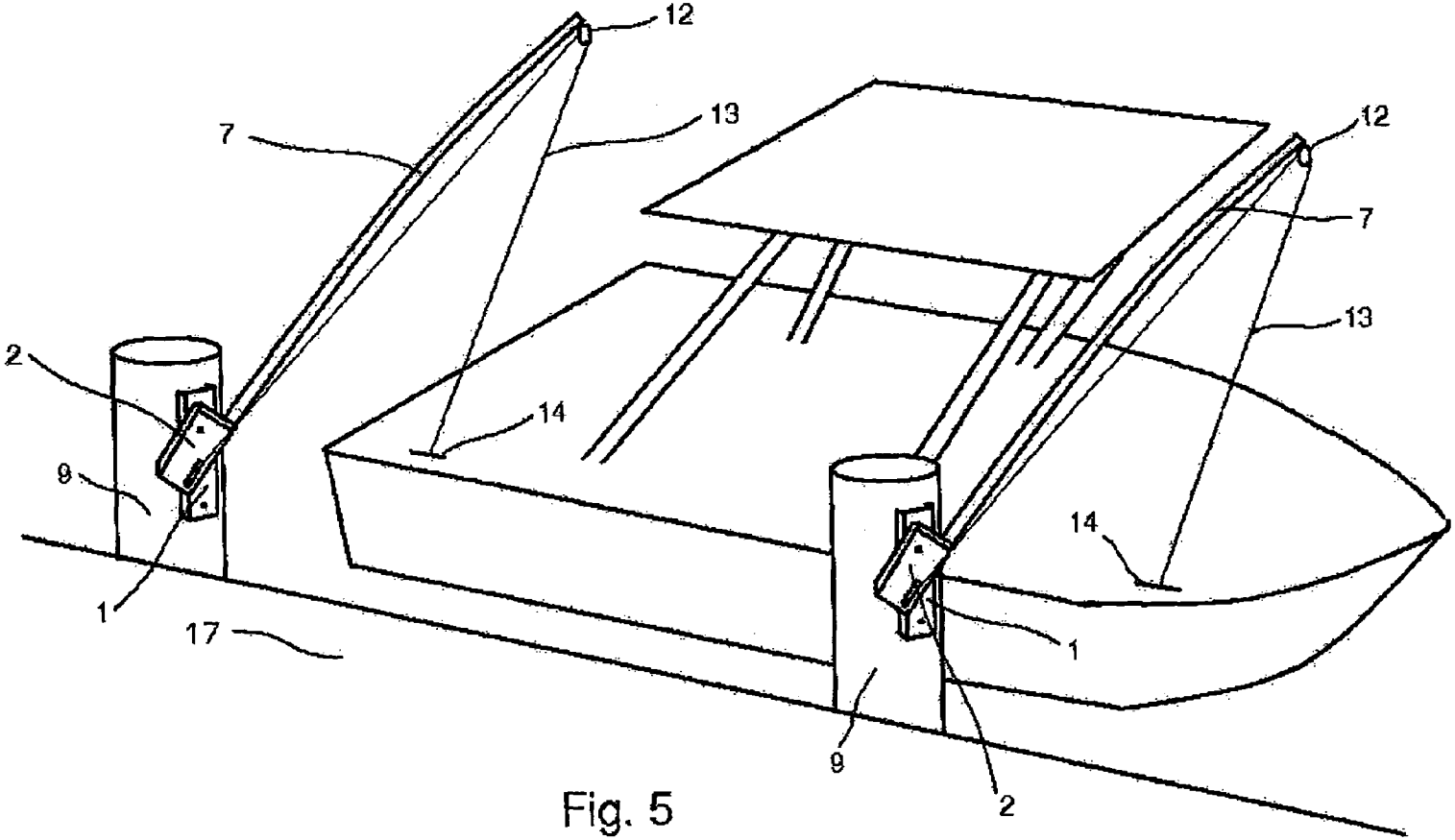
FIG. 5 shows an isometric perspective view of a preferred embodiment engaged with a boat at a dock whereas the preferred embodiment is in a down position keeping the boat at a safe distance from the dock.
Figure 6:
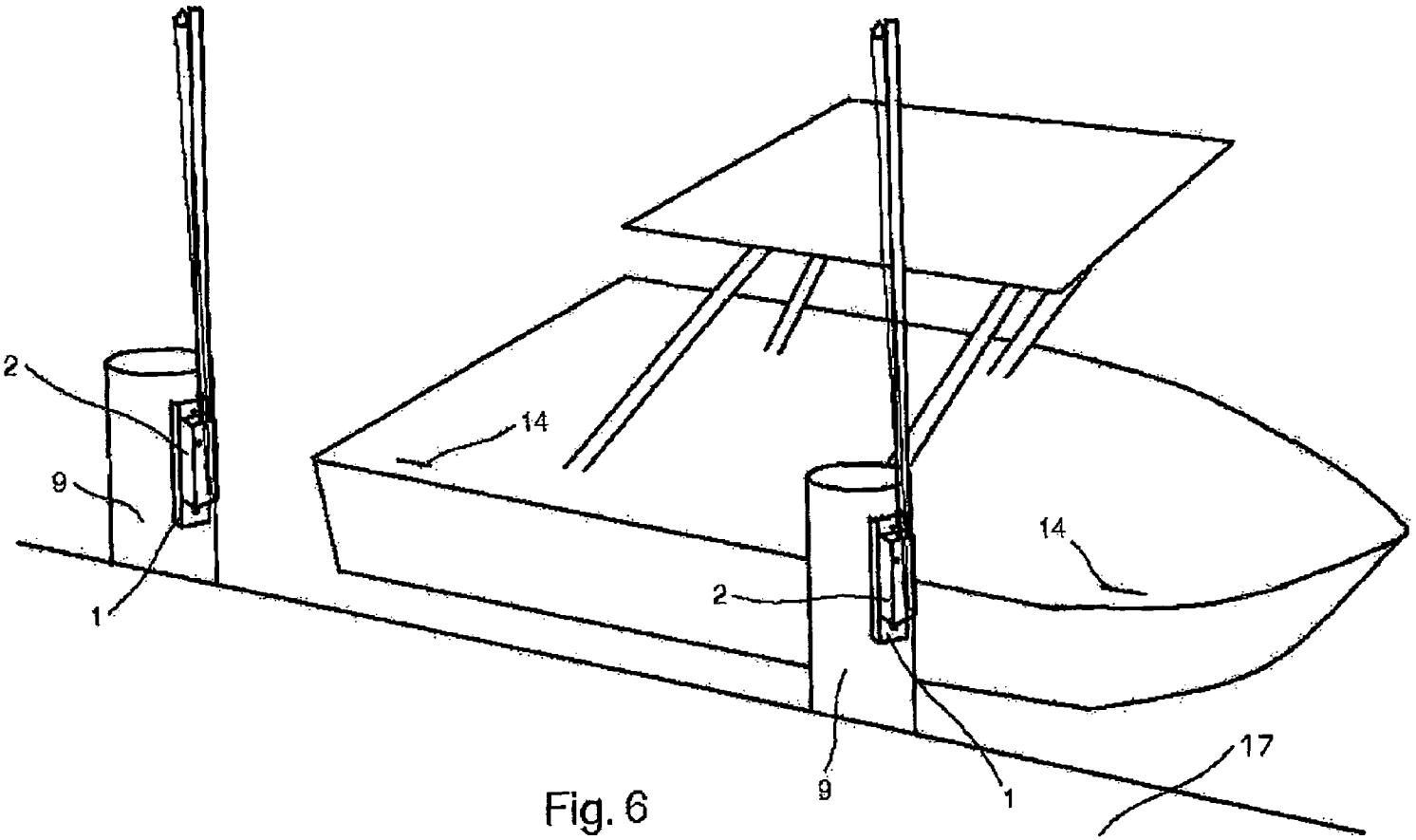
FIG. 6 shows an isometric perspective view of a preferred embodiment engaged with a boat at a dock whereas the preferred embodiment is in a vertical position clearing any boat obstacles which may interfere with the whip poles when leaving or returning the boat dock.

The preferred embodiment mooring whip vertical mounting swivel support base as illustrated in FIGS. 1 through 6 comprising a mounting support 1 including two mounting holes 6 drilled through mounting support 1 rotatable whip pole housing support 2 whip pole housing support stop 3 means to rotate rotatable whip pole housing support 2 by means of mounting support shaft bolt 5 resting and limit stop 3 securely fastened to mounting support 1 fastened securely within the rotatable whip pole housing support 2 is the whip pole tube support 8 of which the whip pole 7 inserts, when in the vertical position the rotatable whip pole housing support 2 is locked in place by means of the vertical position lock 4 as illustrated in FIGS. 1, 3 and 6 when the rotatable whip pole housing support 2 is in a angled rotated down position in FIGS. 2, 4 and 5. For the purpose of clarity the retaining base cleat 10 is not shown in FIGS. 1 and 2.

Operation

Refer to FIGS. 1 Through 6

The mooring whip vertical mounting swivel support base when securely piling 9 mounted engages with a boat by attaching a line 13 or rope from the support base 1 to a base cleat 10 through a pulley 12 securely fastened to the end opposite the rotatable whip pole housing support 2 end then attached to a cleat on the boat 14 as illustrated in FIGS. 5 and 6 angled in such a way over the boat flexing the pole 7 providing tension to the line 13 holding the boat away from the dock as illustrated in FIG. 5 when said line 13 is released from said boat the rotatable whip pole housing support 2 may be rotated manually to a vertical position as shown in FIGS. 2 and 6 engaging the limit stop 3 by rotating the vertical position lock 4 to a locking position will maintain the rotatable whip pole housing support 2 in a vertical position clearing the whip poles 7 from interfering with boat obstructions when leaving or returning from the dock as illustrated in FIG. 6.

A Detailed Description of the Invention

Refer to FIGS. 1 through 6

This invention relates to a permanently vertically mounted mooring whip mounting support 1 which is securely fastened by placing bolts or threaded bar with securing nuts through mounting support mounting holes 6 to wood or concrete pilings or any other secure structure by bolting the mounting support 1 as shown in FIGS. 5 and 6 rotatable whip pole housing support 2 is assembled to the mounting support 1 by placing the shaft bearing 15 over the mounting support shaft bolt 5 and securing with the mounting support shaft retaining nut 16 tightened enough to allow free rotation of the whip pole housing support 2 on the mounting support shaft bolt 5 as shown in FIGS. 1 through 4 which allows the rotatable whip pole housing support 2 to be manually swiveled bringing the whip pole 7 which is inserted into the whip pole tube support 8 as shown in FIGS. 1, 2 and 3 to an up right vertical position clearing any boat obstacles which may interfere with the whip poles 7 when leaving or returning the boat to the dock as shown in FIGS. 5 and 6 as this vertical position of the whip poles 7 may be maintained by moving the vertical position lock 4 into the locked position preventing the rotatable whip pole housing support 2 from rotating back to the angled position by rotating the vertical position lock 4 back to an unlocked position the rotatable whip pole housing support 2 can be rotated down to a position as shown in FIGS. 2,4 and 5 whereas the whip pole 7 is extended out from the boat dock 17 over the boat keeping the boat a safe distance from the boat dock 17 by means of the resilient spring action of the whip poles 7 tensioned by the whip lines 13 attached to the mooring whip vertical mounting swivel support bases cleat 10 through the pulley 12 to the boat cleat 14 as shown in FIGS. 5 and 6.

Advantages

From the description above, a number of advantages of the preferred embodiment of my mooring whip vertical mounting swivel support base become evident:

Having the means and particular structure and soundness of to be vertically mounted the mooring whip vertical mounting swivel support base can be more securely mounted to a portion of a dock structure that provides a more substantial means of support required for loads that occur from boats larger or small.

The ability to mechanically swivel to a vertical position the base support containing the whip pole and its housing to a vertical position eliminating any possible collision with the whip poles and lines attached to the whip poles and any part of the boat while leaving or returning from docking a boat.

The ability to manually swivel to a vertical position the base support and the ability to maintain a positive vertical position by means of a locking device unquestionably secures the whip pole in a vertical position eliminating any possible collision with the whip poles and lines attached to the whip poles and any part of the boat while leaving or returning from docking a boat.

The installation of the mooring whip vertical mounting swivel support base is accomplished simply with two screw bolts accessible in clear view once the mounting support is secured in a vertical position the rotatable whip pole housing support bearing is slipped over the mounting support shaft bolt and secured with the mounting shaft retaining nut.

While the above description contains much specificity, they should not be construed as limitations on the scope of the invention, but rather as an exemplification of one preferred embodiment thereof. Many other variations are possible, for example:

The width, length, size and shape of all the components may vary but with no effectual change on the advantages this invention demonstrates.

This invention demonstrates how the whip poles may be rotated vertically positioning manually, this can also be accomplished by other means with the use of counter weights and the introduction of assisting tension springs therefore the swivel vertically may be automatic when the line is released. The whip poles may also be extended out over the dock and boat using a vertical mount but in a fixed position secured firmly to the vertical support. While the above descriptions contain much specificity, they should not be construed as limitations on the scope of the invention, but rather as an exemplification of one preferred embodiment thereof. Many other variations are possible, for example:

A The width, length, size and shape of all the components may vary but with no effectual change on the advantages of this invention demonstrates.

B. This invention demonstrates how the whip poles may be rotated vertically positionally manually, this can also be accomplished by other means with the use of counter weights and the introduction of tension springs therefore the vertical swivel may be automatic.

C. The whip poles may also be extended over the dock and boat using a vertical mount but in a fixed angled position secured firmly to the vertical support.

I claim:

1. A mooring whip base vertically mounted to a dock piling or another structural member of said dock or an adjacent structural member for securing a boat, wherein the mooring whip base comprises:

a mounting support comprised of an c-channel having a web and parallel flanges on either side of the web, said mounting support having a mounting hole through the web near a top end and a mounting hole through the web near a bottom end for securing the mounting support to the dock; a rectangular limit stop fixedly connected to one flange proximate the top end of the mounting support and extending above the web of the mounting support, a vertical position locking tab rotatably connected proximate the bottom end of the same flange as the limit stop;

a rotatable whip pole housing support, comprised of a rectangular tube, said whip pole housing support rotatably attached to the mounting support by an offset mounting support shaft bolt, a mounting support shaft bearing and mounting support retaining nut, said whip pole housing support having a whip pole tube support within the whip pole housing support for receiving and securing one end of a whip pole, an opposite end of the whip pole having a pulley attached for tensioning a whip line, said whip pole housing support including a base cleat attached on an outer surface of the whip pole housing support for securing the whip line, wherein, when the rotatable whip pole housing support is rotated to a vertical position, the vertical position locking tab can be rotated perpendicular to the flange to lock the whip pole housing support in the vertical position abutting the rectangular limit stop, clearing the whip pole from any boat obstacles as a boat approaches or departs the dock, and when the vertical position locking tab is rotated to align with the flange the vertical whip pole housing support is able to rotate until rotation is blocked by the limit stop, such that the whip pole extends out from the boat dock to keep the boat a distance from the boat dock by means of resilient spring action of the whip poles tensioned by the whip line attached on one end to the base cleat and extending through the pulley and attached on an opposite end to the boat.

* * * * *